US008813385B2

(12) United States Patent
Blum

(10) Patent No.: US 8,813,385 B2
(45) Date of Patent: Aug. 26, 2014

(54) COLLAPSIBLE CHAMBER USING AN EXTERNAL HEAT SOURCE TO DRY WIGS

(71) Applicant: Sheryl Blum, Rosemead, CA (US)

(72) Inventor: Sheryl Blum, Rosemead, CA (US)

( * ) Notice: Subject to any disclaimer, the term of this patent is extended or adjusted under 35 U.S.C. 154(b) by 0 days.

(21) Appl. No.: 13/674,305

(22) Filed: Nov. 12, 2012

(65) Prior Publication Data

US 2014/0130366 A1 May 15, 2014

(51) Int. Cl.
*A45D 20/12* (2006.01)
*A45D 1/04* (2006.01)

(52) U.S. Cl.
USPC ..... 34/97; 34/101

(58) Field of Classification Search
USPC ..... 34/73, 80, 96–101, 103–105, 202, 239, 34/283, 622, 490; 135/126
See application file for complete search history.

(56) References Cited

U.S. PATENT DOCUMENTS

| | | | | |
|---|---|---|---|---|
| 3,125,424 | A | 3/1964 | Peck | |
| 3,188,752 | A | 6/1965 | Skinner | |
| 3,264,755 | A * | 8/1966 | Moore | 34/622 |
| 3,274,040 | A * | 9/1966 | Chambers et al. | 156/258 |
| 3,298,113 | A | 1/1967 | Friedman | |
| 3,327,404 | A | 6/1967 | Ganier | |
| 3,501,846 | A | 3/1970 | Melega | |
| 3,518,776 | A | 7/1970 | Wolff | |
| 3,577,650 | A | 5/1971 | Brahm | |
| 3,608,203 | A * | 9/1971 | Willat | 34/91 |
| 3,757,429 | A | 9/1973 | Sumino | |
| 3,905,125 | A | 9/1975 | Hubner | |
| 3,958,340 | A | 5/1976 | Meyers | |
| 4,185,398 | A | 1/1980 | LaMont | |
| 5,388,344 | A | 2/1995 | Wallach | |
| 5,528,840 | A | 6/1996 | Pajak | |
| 5,555,648 | A | 9/1996 | Griffin | |
| 5,992,039 | A | 11/1999 | Bunch | |
| D468,873 | S | 1/2003 | Varma | |
| 2005/0127056 | A1 | 6/2005 | Petkov | |
| 2007/0039640 | A1 * | 2/2007 | Zheng | 135/126 |

* cited by examiner

*Primary Examiner* — Kenneth Rinehart
*Assistant Examiner* — John McCormack
(74) *Attorney, Agent, or Firm* — Shimokaji & Assoc., P.C.

(57) ABSTRACT

A wig-drying apparatus is provided, comprising: a heat resistant fabric having six sections attached to each other at common edges to form a six sided chamber with interior and exterior panels joined with vertical stitching forming air ducts with holes in the interior panels, the chamber configured to hold a wig for drying; a wire frame within sleeves around the common edges of four of the sides of the chamber, the wire frame and chamber having a box-like configuration and a collapsed configuration; and a collapsible air intake tube secured at one end to an opening in one side of the fabric and having a second end configured to removably receive and retain an air outlet end of a blow dryer to provide hot air to circulate within the chamber and bake dry the wig when the wire frame and chamber are in the box-like configuration.

6 Claims, 6 Drawing Sheets

COLLAPSIBLE CHAMBER USING AN EXTERNAL HEAT SOURCE TO DRY WIGS

BACKGROUND OF THE INVENTION

The present invention generally relates to wigs, and more particularly, to a collapsible countertop chamber using an external heat source to bake dry wigs.

Wigs may be worn for any of a variety of reasons, including fashion, religion, any form of hair loss, or simply for aesthetics allowing one to wear wigs in a style that might not be possible with one's own hair. Wigs need to be washed, set, and dried periodically. Drying a wig without the proper apparatus will take a long period of time as using a hand held dryer has no uniform drying effect or setting it in the sun to bake dry is a days process.

As can be seen, there is a need for an apparatus for drying wigs that is compact, may be used in the home or in a professional salon, and does not require manual manipulation of the dryer or the wig to uniformly bake dry.

SUMMARY OF THE INVENTION

In one aspect of the present invention, a wig-drying apparatus is provided, comprising: a six sided heat resistant fabric having six sections attached to each other at common edges to form a six sided chamber, three of the sides comprising double fabric forming interior and exterior panels, the interior and exterior panels joined with vertical stitching forming air ducts with holes in the interior panels, the chamber configured to hold a wig for drying; a collapsible wire frame within sleeves around the of common edges of four of the sides of the chamber, the wire frame and the chamber having a first, box-like configuration and a second, collapsed configuration; and a collapsible air intake tube secured at one end to an opening in the exterior panel of a first side of the fabric and having a second end configured to removably receive and retain an air outlet end of a blow dryer to provide hot air flow into the space between the exterior and interior panels, through the air ducts and to circulate within the chamber and bake dry the wig when the wire frame and chamber are in the first, box-like configuration.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention generally provides a collapsible countertop chamber using an external heat source to dry wigs.

Referring to FIGS. 1-6, an apparatus for drying a single wig is shown according to an exemplary embodiment of the present invention. The apparatus may include a chamber 10 formed by a flexible wire frame 26 and a heat resistant fabric 16*a*. The fabric 16*a* may be cut with six sections which, when their edges are sewn or otherwise attached to each other at common edges, may form a six sided chamber 10 (including a bottom and a top). Three of the sides may be double fabric forming exterior and interior panels 16*a*, 16*b* sewn together with vertical stitching to create air ducts with holes in the interior panels to evenly distribute the airflow. A space 16*c* is formed between the two panels 16*a*, 16*b*. Sleeves 22 may be formed along common edges of the four sections that form the front, back and sides of the chamber 10. The wire frame 26 may be made from four loops of steel wire having a cross-sectional dimension such as, for example, about 1 mm by about 3 mm. The four wire loops may fit within the four sleeves 22. The wire frame 26, and therefore the chamber 10, may have a first, box-like configuration and a second, collapsed configuration.

Figure 1:
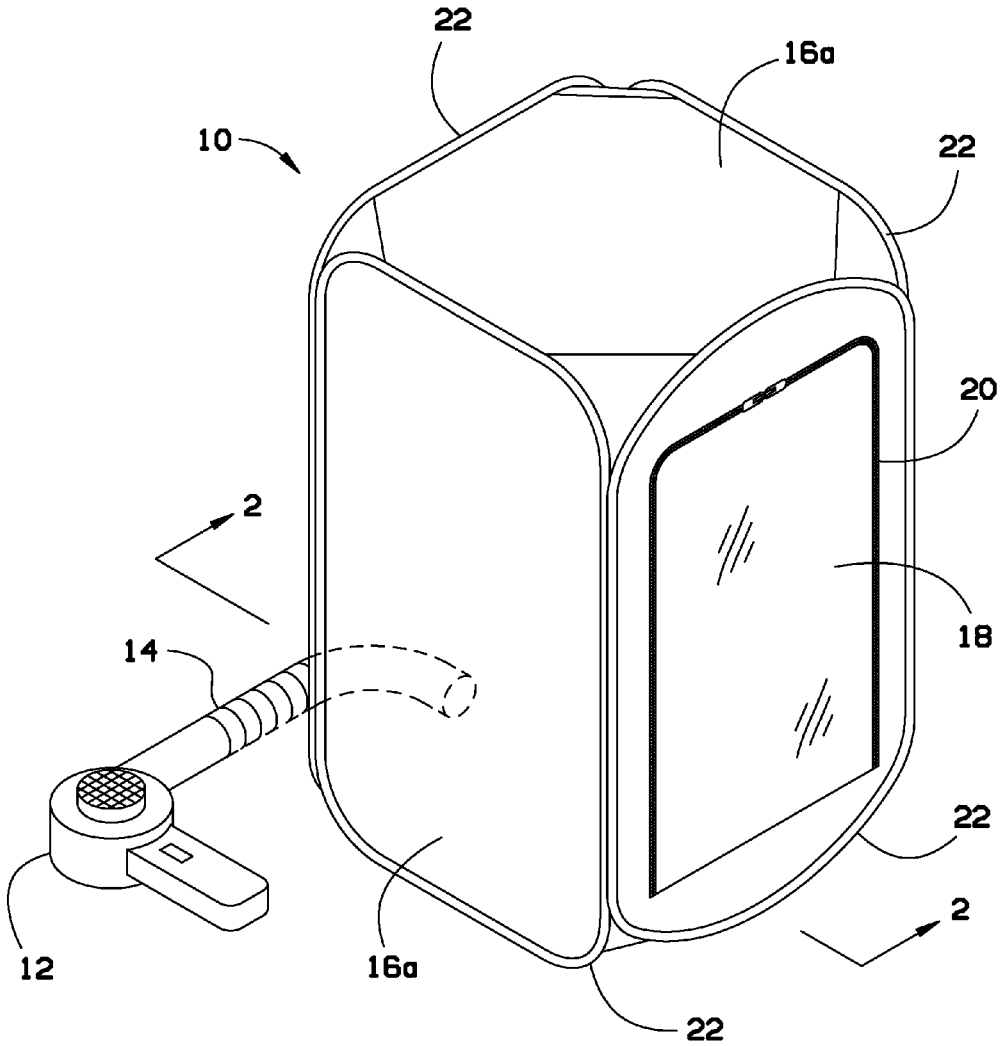
FIG. 1 is a front perspective view of an exemplary embodiment of a wig drying apparatus of the present invention having a single-wig capacity.

A front side of the chamber 10 may include a door 18 that may be made from a clear plastic to view the inside of the chamber 10. The door 18 may be permanently attached to the panel 16*a* on one edge (such as the lower edge) as illustrated in FIG. 1. A zipper 20 around the other three edges may allow the door 18 to be opened and closed. It will be appreciated that other means may be used to allow the door to be opened and closed.

Figure 2:
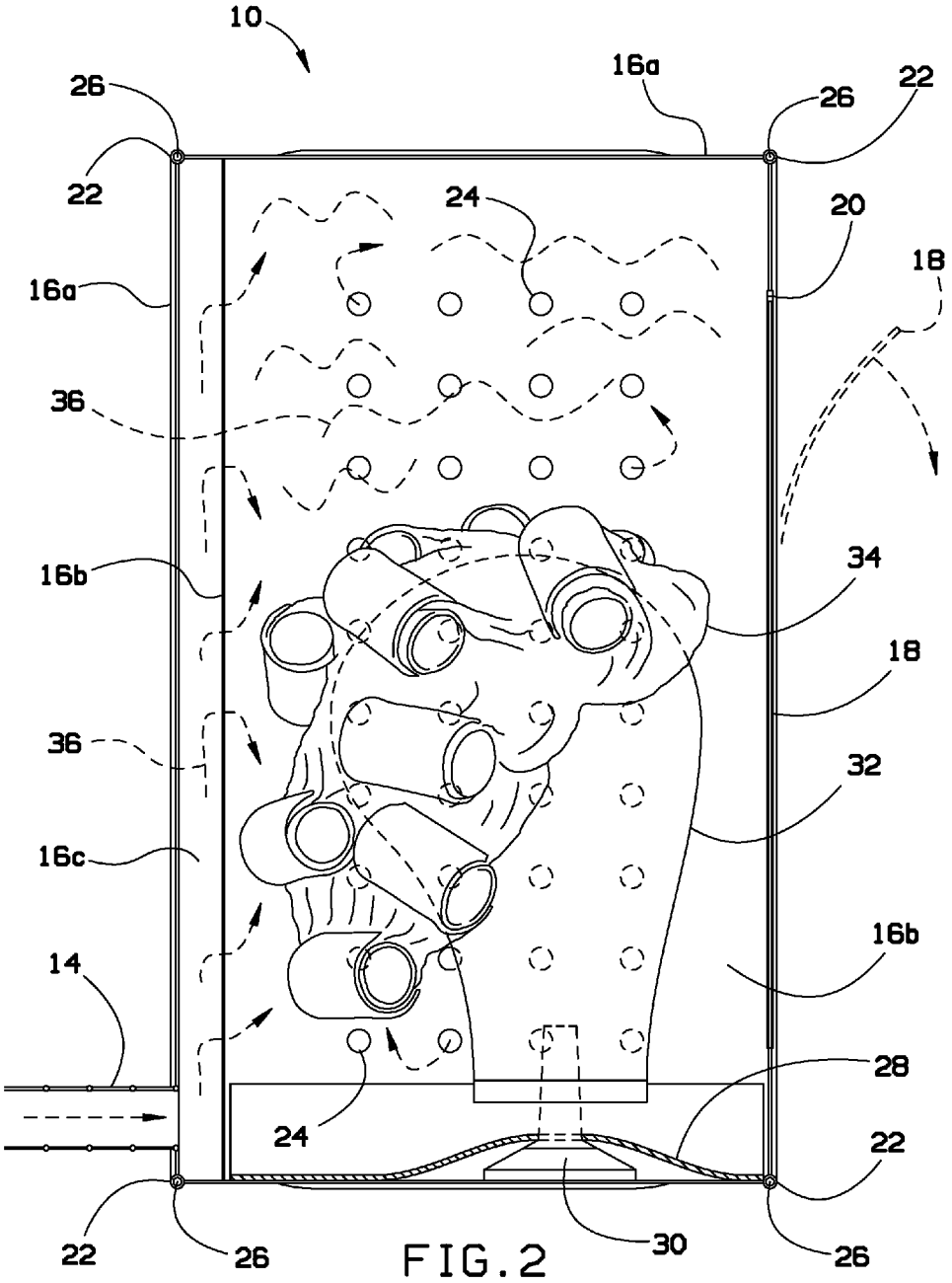
FIG. 2 is section view of the wig drying apparatus taken along line 2-2 in FIG. 1.
Figure 3:
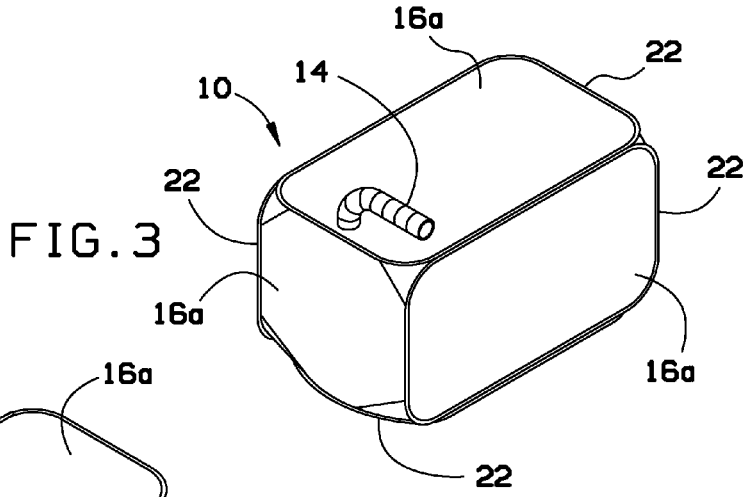
FIG. 3 is a rear perspective view of the wig drying of apparatus FIG. 1.

One end of a flexible air intake tube 14 may be secured to an opening in the exterior panel 16*a* of another side of the chamber 10 (such as the back side) to allow hot air to flow into the space between the exterior and interior panels 16*a*, 16*b*, through the air ducts 24, and into interior of the chamber 10, as illustrated in FIG. 2. The other end of the intake tube 14 is designed to removably receive and retain the air outlet end of a hand-held blow dryer 12 or other external heat source. Within the chamber 10 may be a heat-resistant floor mat 28 and a wig block stand 30.

To use, the chamber 10 may be placed on a counter top or other surface. The door 18 may be opened and a wig block 32, on which a wig 34 to be dried has been placed, may be passed through the door and placed onto the wig block 30 stand within the chamber 10. The door 18 may then be closed. After a hair dryer 12 is attached to the air intake tube 14, the dryer may be turned on. Although the hair dryer 12 may have a variety of blower and heat settings, high blower and high heat settings may decrease the drying time of the wig 34. Hot air 36 may enter the chamber 10 through the air intake tube 14, flow through the space 16*c* between the exterior and interior panels 16*a*, 16*b*, and circulate uniformly throughout the chamber 10 via air holes 24 in the inner panel 16*b*. As illustrated in FIG. 2, the air holes 24 are vertical running center of the stitched air ducts of three sides of the panels 16*a*, 16*b* creating the drying chamber 10.

Figure 4:
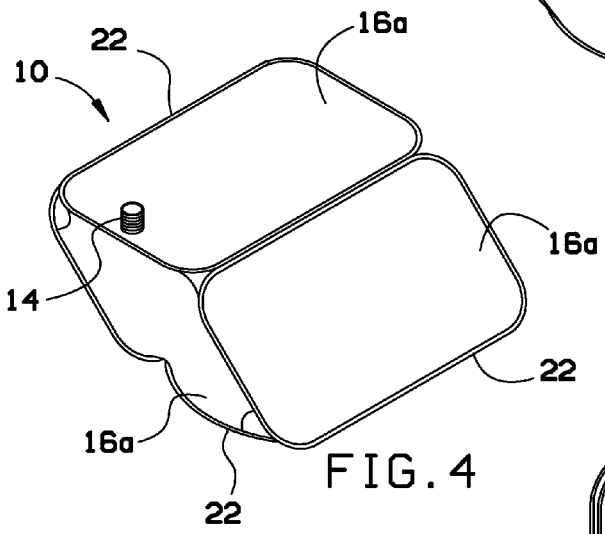
FIG. 4 is a rear perspective view of the wig drying of apparatus FIG. 1 in a semi-collapsed position.
Figure 5:
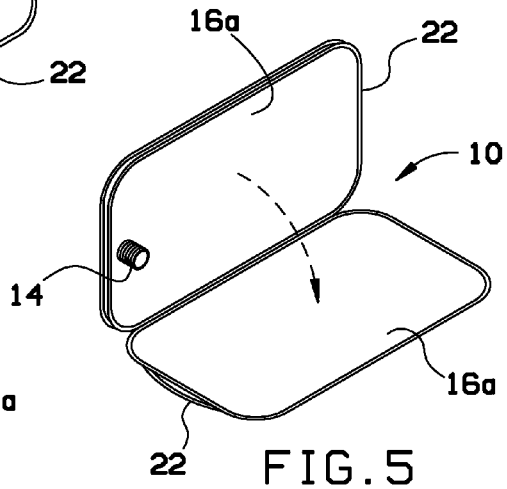
FIG. 5 is a rear perspective view of the wig drying of apparatus FIG. 1 in the collapsed and pre-folded position.
Figure 6:
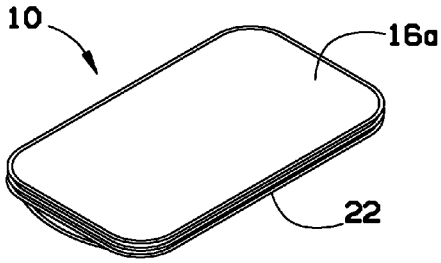
FIG. 6 is a rear perspective view of the wig drying of apparatus FIG. 1 in the fully collapsed and final folded position.
Figure 7:
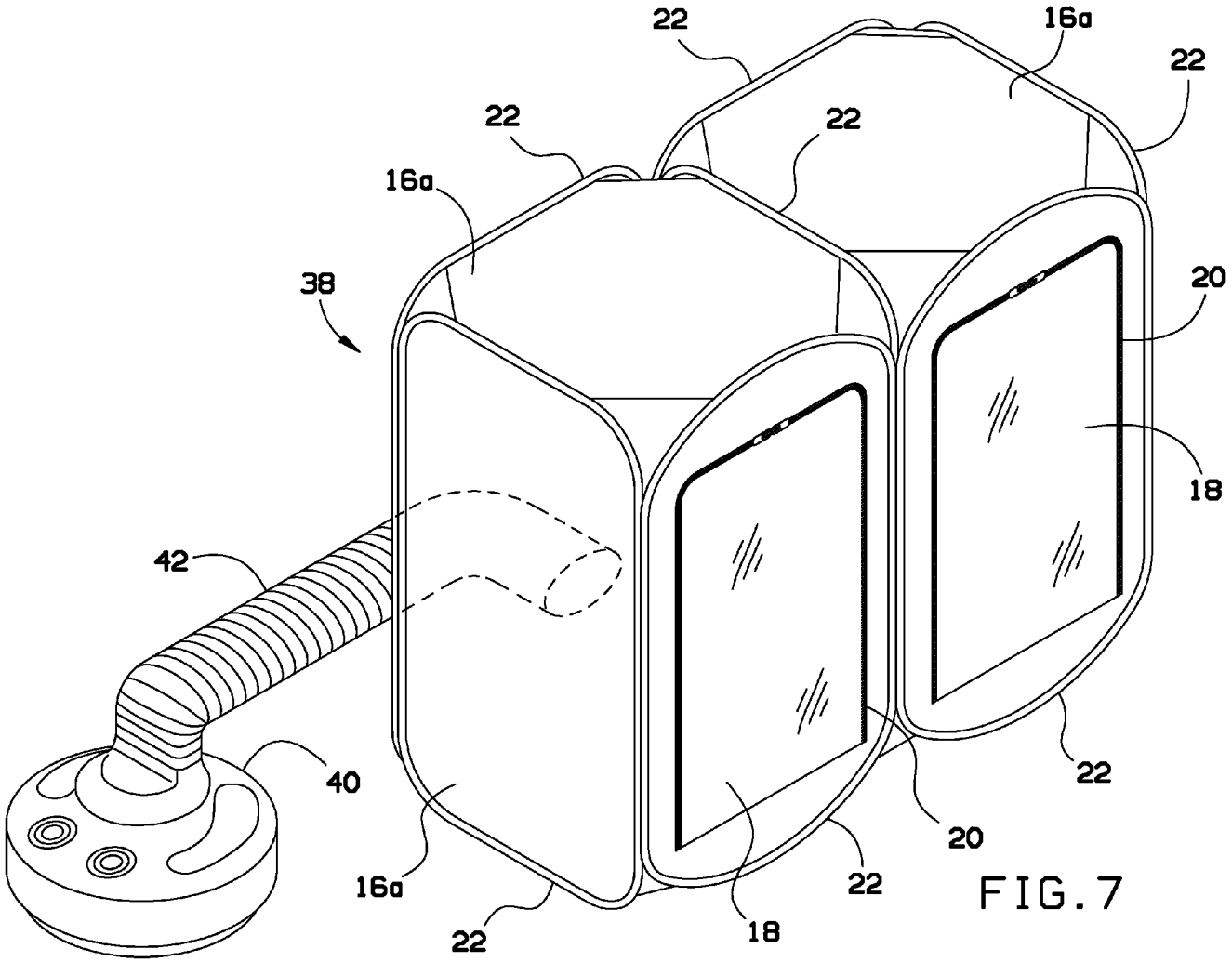
FIG. 7 is a front perspective view of an alternate embodiment of a wig drying of apparatus the present invention having a multiple wig capacity.
Figure 8:
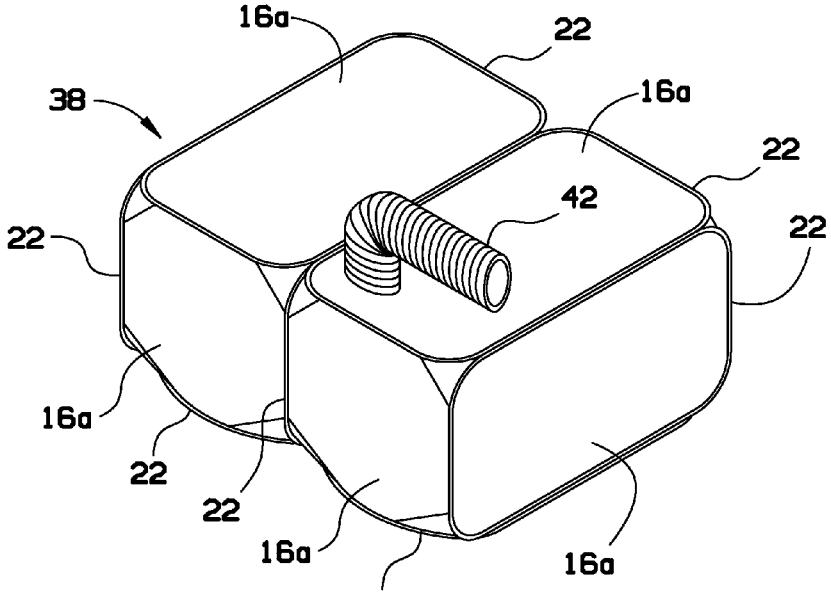
FIG. 8 is a rear perspective view of the wig drying of apparatus FIG. 7.
Figure 9:
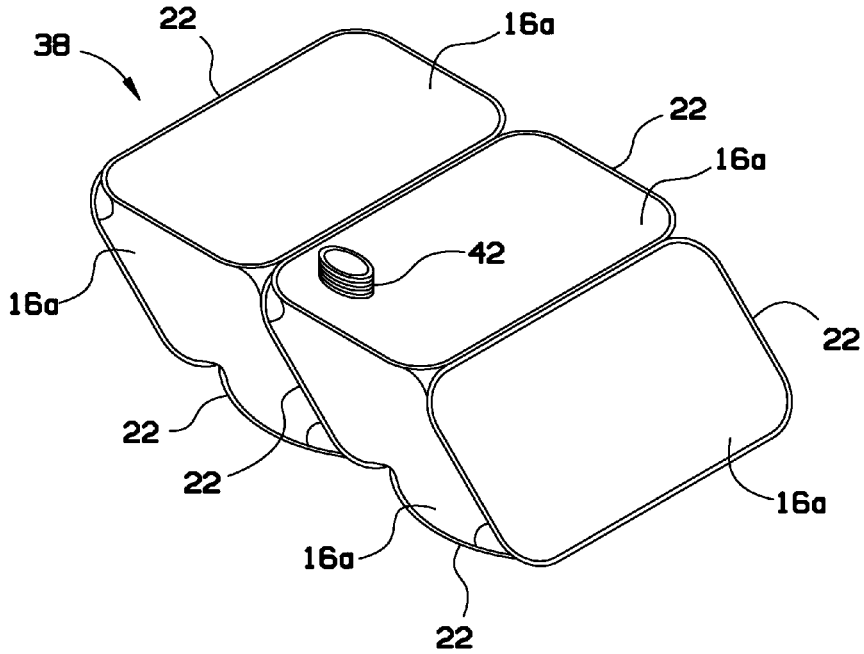
FIG. 9 is a rear perspective view of the wig drying of apparatus FIG. 7 in a semi-collapsed position.
Figure 10:
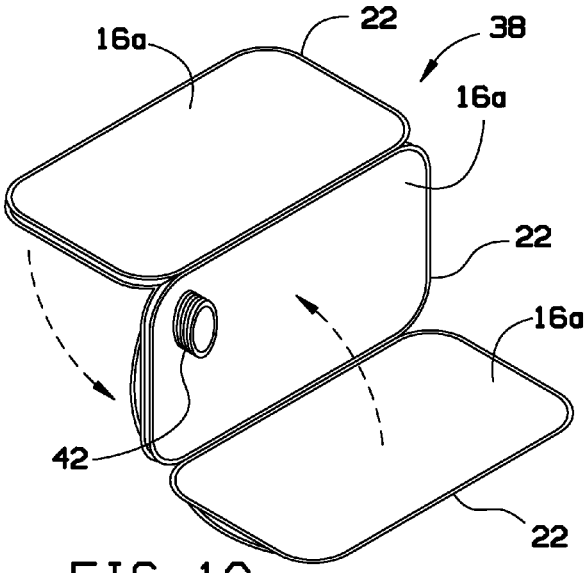
FIG. 10 is a rear perspective view of the wig drying of apparatus FIG. 7 in the collapsed and pre-folded position.
Figure 11:
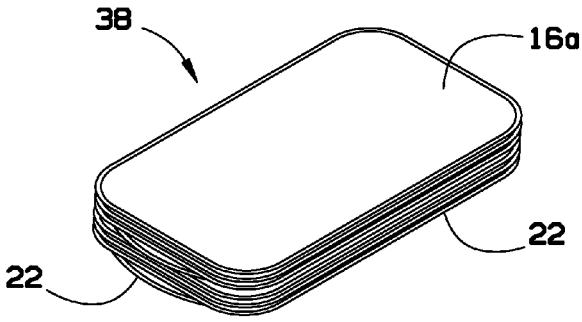
FIG. 11 is a rear perspective view of the wig drying of apparatus FIG. 7 in the fully collapsed and final folded position.

After the wig 34 has been dried, the hair dryer 12 may be turned off and the wig 34, the wig block 32, the wig block stand 30, and the floor mat 28 may be removed from the chamber 10 through the door 18. The hair dryer 12 may be detached from the chamber 10. The chamber 10 and wire frame 26 may then be collapsed for storage, as illustrated in FIGS. 3-6. The air intake tube 14 may be collapsed and one adjoining side of the chamber 10 may be pushed into the center against the two opposite adjoining sides (FIG. 4). The panels of the remaining two sides (such as the top and bottom sections) may be folded onto itself (FIGS. 5 and 6). The apparatus may then be stored in a relatively small space.

Referring to FIGS. 7-11, a chamber 38 that is large enough to dry multiple wigs is shown according to another embodiment of the present invention. The large chamber 38 may have two doors 18 and be heated with a larger drying unit 40 through a larger flexible air intake tube 42. The large chamber 38 may be used to dry wigs in the same way as the smaller chamber 10 and may be collapsed by pressing the opposing corners into the center (FIG. 10), then pressing the three panels together which lay against each other with the fabric of the other two sides sandwiched in between, leaving the chamber 10 and wire frame 26 substantially flat (FIG. 11) for storage.

In contrast to large, cumbersome, and expensive wig driers (that may range in size from four feet by four feet by two feet to six feet by six feet by two feet, the drying chambers 10, 38 of the present invention may be compact, portable, easily stored, and relatively inexpensive.

It should be understood, of course, that the foregoing relates to exemplary embodiments of the invention and that modifications may be made without departing from the spirit and scope of the invention as set forth in the following claims.

What is claimed is:

1. A wig-drying apparatus, comprising:

a fabric having six sections attached to each other at common edges to form a six-sided chamber, three of the sides including double fabric forming interior and exterior panels, the interior and exterior panels joined with vertical stitching forming air ducts with holes in the interior panels, the chamber configured to hold a wig for drying;

a collapsible wire frame within sleeves around the common edges of four of the sides of the chamber, the wire frame and the chamber configured to form:

a first, erect configuration with the wire frame, the first erect configuration including at least two of the interior panels parallel to each other and disposed to be spaced from the wig as the wig is positioned between the at least two interior panels, and a second, collapsed configuration; and a collapsible air intake tube secured at one end to an opening in the exterior panel of a first side of the fabric and having a second end configured to removably receive and retain an air outlet end of a blow dryer to provide hot air to flow into the space between the exterior and interior panels, through the air ducts wherein the holes in the interior panels are positioned to circulate the hot air around the wig within the chamber and bake dry the wig when the wire frame and chamber are in the first, erect configuration.

2. The wig-drying apparatus of claim 1, wherein the wig-drying apparatus is substantially flat when the wire frame and chamber are in the second, collapsed configuration.

3. The wig-drying apparatus of claim 1, further comprising a door in a second side of the fabric through which the wig is passed into the chamber.

4. The wig-drying apparatus of claim 1, wherein the wire frame comprises four wire loops within the four sleeves.

5. The wig-drying apparatus of claim 1, wherein the fabric and the wire frame are configured to hold one wig.

6. The wig-drying apparatus of claim 1, wherein the heat-resistant fabric and the wire frame are configured to hold multiple wigs.

* * * * *